US011348517B2

(12) United States Patent
Ding et al.

(10) Patent No.: US 11,348,517 B2
(45) Date of Patent: May 31, 2022

(54) PIXEL CIRCUIT, DRIVING METHOD THEREOF AND DISPLAY DEVICE

(71) Applicant: BOE TECHNOLOGY GROUP CO., LTD., Beijing (CN)

(72) Inventors: Xiaoliang Ding, Beijing (CN); Xue Dong, Beijing (CN); Haisheng Wang, Beijing (CN); Yingming Liu, Beijing (CN); Wei Liu, Beijing (CN); Changfeng Li, Beijing (CN); Pengpeng Wang, Beijing (CN); Huizhong Zhu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 240 days.

(21) Appl. No.: 16/609,475

(22) PCT Filed: Jan. 18, 2019

(86) PCT No.: PCT/CN2019/072405
§ 371 (c)(1),
(2) Date: Oct. 30, 2019

(87) PCT Pub. No.: WO2019/218719
PCT Pub. Date: Nov. 21, 2019

(65) Prior Publication Data

US 2021/0335239 A1 Oct. 28, 2021

(30) Foreign Application Priority Data

May 14, 2018 (CN) ..... 201810456304.7

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01); *G09G 2310/0291* (2013.01); *G09G 2360/14* (2013.01)

(58) Field of Classification Search
CPC ... G09G 3/3233; G09G 3/3266; G09G 3/3275
See application file for complete search history.

(56) References Cited

U.S. PATENT DOCUMENTS

2014/0313111 A1* 10/2014 Chaji ..... G09G 3/3291 345/82
2015/0243217 A1 8/2015 Park et al.
(Continued)

FOREIGN PATENT DOCUMENTS

CA 2509201 12/2006
CN 101290762 10/2008
(Continued)

OTHER PUBLICATIONS

International Search Report and Written Opinion dated Apr. 3, 2019 for PCT Patent Application No. PCT/CN2019/072405.
(Continued)

*Primary Examiner* — Kent W Chang
*Assistant Examiner* — Scott D Au
(74) *Attorney, Agent, or Firm* — Thomas | Horstemeyer LLP

(57) ABSTRACT

The present disclosure relates to the field of display technology, and more particularly, to a pixel circuit, a driving method thereof, and a display device. The pixel circuit may comprise a first switch element, a driving transistor, a storage capacitor, a second switch element, and a photosensitive element.

17 Claims, 4 Drawing Sheets

(56) References Cited

U.S. PATENT DOCUMENTS

| | | | | |
|---|---|---|---|---|
| 2018/0323243 | A1* | 11/2018 | Wang | H01L 27/3281 |
| 2019/0164493 | A1* | 5/2019 | Liu | G09G 3/3258 |

FOREIGN PATENT DOCUMENTS

| | | | |
|---|---|---|---|
| CN | 101887691 | | 11/2010 |
| CN | 102194413 | A | 9/2011 |
| CN | 102194413 | B | 10/2012 |
| CN | 104021756 | | 9/2014 |
| CN | 104064140 | | 9/2014 |
| CN | 104102382 | | 10/2014 |
| CN | 106782319 | | 5/2017 |
| CN | 106991976 | | 7/2017 |
| CN | 107863065 | | 3/2018 |
| CN | 108447443 | | 8/2018 |

OTHER PUBLICATIONS

1st Office Action dated Jun. 26, 2019 for Chinese Patent Application No. 201810456304.7.

* cited by examiner

PIXEL CIRCUIT, DRIVING METHOD THEREOF AND DISPLAY DEVICE

CROSS-REFERENCE TO RELATED APPLICATIONS

The present application is based upon International Application No. PCT/CN2019/072405, filed on Jan. 18, 2019, which claims the benefit of and priority to Chinese Patent Application No. 201810456304.7, filed on May 14, 2018, the entire disclosure of which is hereby incorporated by reference as a part of the present application.

TECHNICAL FIELD

The present disclosure relates to the field of display technology, and more particularly, to a pixel circuit, a driving method thereof, and a display device.

BACKGROUND

In a display device, a driving circuit is required to drive pixels of the display panel, such that the pixels (e.g., electroluminescent elements) emit light having required brightness, to display a desired image. However, the driving currents of the electroluminescent elements may drift due to the change and unevenness of the threshold voltage and mobility of the driving transistors and the driving voltage of the electroluminescent elements, so that the luminance of the electroluminescent elements in each pixel unit is inconsistent, thereby causing the brightness uniformity of a display screen to decrease.

It should be noted that information disclosed in the above section of "Background Art" is only for enhancement of understanding of the background of the present disclosure, and thus may include information that does not constitute the prior art known to an ordinary person skilled in the art.

SUMMARY

The present disclosure provides a pixel circuit, a driving method, and a display device.

According to an aspect of the present disclosure, a pixel circuit for driving an electroluminescent element to emit light is provided, comprising:

a first switch element configured to be turned on in response to a scan signal, and transmit a data signal to a first node;

a driving transistor configured to be turned on in response to a signal of the first node, and output a driving current to a first electrode of the electroluminescent element under the action of a first power supply signal;

a storage capacitor having a first terminal being connected to the first node, a second terminal being connected to the first electrode of the electroluminescent element, and a second electrode of the electroluminescent element receiving a second power supply signal;

a second switch element configured to be turned on in response to the scan signal, and communicate with the first electrode of the electroluminescent element and a detection line; and a photosensitive element connected to the detection line, and configured to acquire an optical signal of the electroluminescent element, so that an external compensation circuit collects an optical signal acquired by the photosensitive element through the detection line at a stage in which the pixel circuit drives the electroluminescent element to emit light, and compensates the data signal according to the optical signal.

In an exemplary embodiment of the present disclosure, the first switch element has a control terminal receiving the scan signal, a first terminal receiving the data signal, and a second terminal connected to the first node;

the driving transistor has a control terminal connected to the first node, a first terminal receiving the first power supply signal, and a second terminal connected to the first electrode of the electroluminescent element;

the second switch element has a control terminal receiving the scan signal, a first terminal connected to the detection line, and a second terminal connected to the first electrode of the electroluminescent element; and the photosensitive element has a first electrode connected to the second electrode of the electroluminescent element and a second electrode connected to the detection line.

In an exemplary embodiment of the present disclosure, the external compensation circuit comprises:

a modulation and demodulation sub-circuit configured to demodulate the optical signal according to a frequency of the scan signal.

In an exemplary embodiment of the present disclosure, the external compensation circuit further comprises:

an operational amplifier having a first terminal connected to the detection line, a second terminal connected to the second power supply signal, and a third terminal connected to the modulation and demodulation sub-circuit; and a resistor connected between the first terminal and the third terminal of the operational amplifier.

In an exemplary embodiment of the present disclosure, a plurality of pixel circuits each being the pixel circuit are arranged in an array, wherein:

detection lines in the pixel circuits belonging to a same column and driving the electroluminescent elements to emit light at different times are connected to a same external compensation circuit; or detection lines in the pixel circuits belonging to different columns and driving the electroluminescent elements to emit light at different times are connected to a same external compensation circuit.

In an exemplary embodiment of the present disclosure, the switch element and the driving transistor each is an N-type thin film transistor, the first power supply signal is a high level signal, and the second power supply signal is a low level signal; or the switch element and the driving transistor each are a P-type thin film transistor, the first power supply signal is a low level signal, and the second power supply signal is a high level signal.

According to one aspect of the present disclosure, there is provided a pixel circuit driving method for driving the pixel circuit according to any one of the above, the pixel circuit driving method comprising:

in a charging phase, the first switch element and the second switch element are turned on with the scan signal, the data signal is transmitted to the first node, and the second power supply signal is transmitted to the first electrode of the electroluminescent element to charge the storage capacitor through the data signal and the second power supply signal; and in a light emitting phase, the driving transistor is turned on with the signal of the first node, and the driving current is outputted under the action of the first power supply signal to drive the electroluminescent element to emit light, and the photosensitive element acquires and transmits the optical signal of the electroluminescent element to the external compensation circuit through the detection line, so that the external compensation circuit compensates the data signal in accordance with the optical signal.

In an exemplary embodiment of the present disclosure, the external compensation circuit comprises a modulation and demodulation sub-circuit; and the external compensation circuit compensating the data signal according to the optical signal comprises:

demodulating the optical signal according to a frequency of the scan signal by using the modulation and demodulation sub-circuit, and compensating the data signal according to the demodulated optical signal.

In an exemplary embodiment of the present disclosure, the switch elements each are an N-type thin film transistor, and conduction levels of the switch elements each are a high level; or the switch elements each are a P-type thin film transistor, and the conduction levels of the switch elements each are a low level.

According to one aspect of the present disclosure, there is provided a display device comprising any one of the pixel circuits described above.

It should be noted that information disclosed in the above section of "Background Art" is only for enhancement of understanding of the background of the present disclosure, and thus may include information that does not constitute the prior art known to an ordinary person skilled in the art.

BRIEF DESCRIPTION OF THE DRAWINGS

The above and other features and advantages of the present disclosure will become more apparent from the detailed description of exemplary embodiments thereof with reference to the accompanying drawings. It would be apparent for an ordinary person skilled in the art that the accompanying drawings in the following description are only some of the embodiments of the present disclosure, and other drawings may be obtained from these drawings without making creative efforts. In the accompanying drawings.

DETAILED DESCRIPTION

Figure 1:
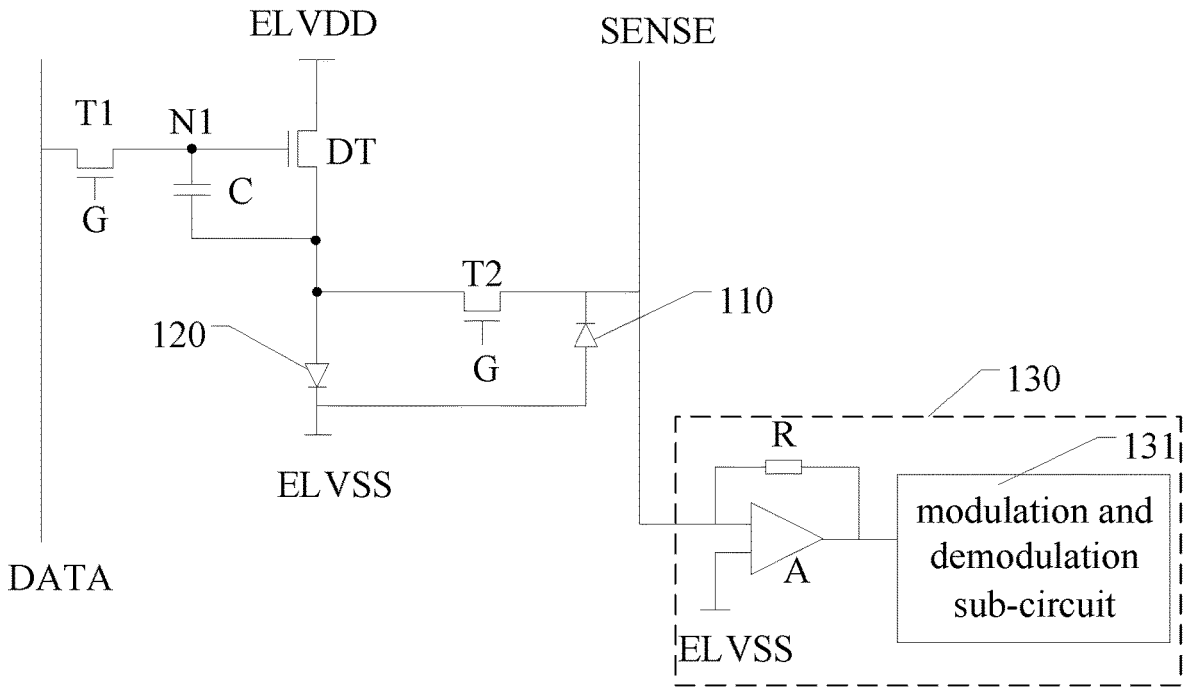
FIG. 1 is a schematic structural diagram of a pixel circuit of the present disclosure.

Exemplary embodiments will now be described more fully with reference to the accompanying drawings. However, the exemplary embodiments can be embodied in many forms and should not be construed as being limited to the embodiments set forth herein. Rather, these embodiments are provided so that this disclosure will be thorough and complete, and the concepts of the exemplary embodiments are fully conveyed to those skilled in the art. The described features, structures, or characteristics may be combined in any suitable manner in one or more embodiments. In the following description, many specific details are set forth to provide a thorough understanding of the embodiments of the present disclosure. However, those skilled in the art will appreciate that the technical solution of the present disclosure may be practiced without one or more of the specific details, or other methods, components, materials, devices, steps, and so on may be employed. In other instances, well-known technical solutions are not shown or described in detail to avoid obscuring aspects of the present disclosure.

In addition, the accompanying drawings are merely schematic illustrations of the present disclosure, and are not necessarily drawn to scale. The same reference numerals in the drawings denote the same or similar parts, and a repeated description thereof will be omitted.

In the present exemplary embodiment, a pixel circuit is provided which can be used to drive an electroluminescent element to emit light, thereby overcoming at least to some extent the problems that the aging of an electroluminescent element in a pixel cannot be compensated and the compensation range is small. Referring to FIG. 1, the pixel circuit may include a first switch element T1, a driving transistor DT, a storage capacitor C, a second switch element T2, and a photosensitive element 110. Among them:

the first switch element T1 is configured to be turned on in response to a scan signal G, and transmit a data signal DATA to a first node N1;

the driving transistor DT is configured to be turned on in response to a signal of the first node N1, and output a driving current to a first electrode of the electroluminescent element 120 under the action of a first power supply signal ELVDD;

the storage capacitor C has a first terminal being connected to the first node N1, and a second terminal being connected to the first electrode of the electroluminescent element 120, and a second electrode of the electroluminescent element 120 receiving a second power supply signal ELVSS;

the second switch element T2 is configured to be turned on in response to the scan signal G, and communicate with the first electrode of the electroluminescent element 120 and a detection line SENSE; and a photosensitive element 110 is connected to the detection line SENSE, and is configured to acquire an optical signal of the electroluminescent element 120, so that an external compensation circuit 130 collects an optical signal acquired by the photosensitive element 110 through the detection line SENSE at a stage in which the pixel circuit drives the electroluminescent element 120 to emit light and compensates the data signal DATA according to the optical signal.

The switch element and the driving transistor DT each have a control terminal, a first terminal, and a second terminal, and the photosensitive element 110 includes a first electrode and a second electrode, specifically:

the control terminal of the first switch element T1 receives the scan signal G, the first terminal of the first switch element T1 receives the data signal DATA, and the second terminal of the first switch element T1 is connected to the first a node N1;

the control terminal of the driving transistor DT is connected to the first node N1, the first terminal of the driving transistor DT receives the first power supply signal ELVDD, and the second terminal of the driving transistor DT is connected to the first electrode of the electroluminescent element 120;

the control terminal of the second switch element T2 receives the scan signal G, the first terminal of the second switch element T2 is connected to the detection line SENSE, and the second terminal of the second switch element T2 is connected to the first electrode of the electroluminescent element 120; and the first electrode of the photosensitive element 110 is connected to the second electrode of the electroluminescent element 120, and the second electrode of the photosensitive element 110 is connected to the detection line SENSE.

In the present exemplary embodiment, the electroluminescent element 120 is a current-driven electroluminescent element that is controlled to emit light by a current flowing through the driving transistor DT, for example, an OLED, but the electroluminescent element 120 in the present exemplary embodiment is not limited thereto. Further, the electroluminescent element 120 has a first electrode and a second electrode. For example, the first electrode of electroluminescent element 120 may be an anode and the second electrode of electroluminescent element 120 may be a cathode. In another example, the first electrode of the electroluminescent element 120 may be a cathode and the second electrode of the electroluminescent element 120 may be an anode.

The first switch element T1 and the second switch element T2 may correspond to a first switch transistor and a second switch transistor, respectively, and each of the switch transistors has a control terminal, a first terminal, and a second terminal. For example, the control terminal of each switch transistor may be a gate, the first terminal of each switch transistor may be a source, and the second terminal of each switch transistor may be a drain. In another example, the control terminal of each switch transistor may be a gate, the first terminal of each switch transistor may be a drain, and the second terminal of each switch transistor may be a source. In addition, each of the switch transistors may be an enhancement transistor or a depletion transistor, and the present exemplary embodiment is not particularly limited thereto. It should be noted that since the sources and the drains of the switch transistors are symmetric, the sources and the drains of the first switch transistor and the second switch transistor may be interchanged. The driving transistor DT has a control terminal, a first terminal, and a second terminal. For example, the control terminal of the driving transistor DT may be a gate, the first terminal of the driving transistor DT may be a source, and the second terminal of the driving transistor DT may be a drain. In another example, the control terminal of the driving transistor DT may be a gate, the first terminal of the driving transistor DT may be a drain, and the second terminal of the driving transistor DT may be a source. The driving transistor DT may be an enhancement transistor or a depletion transistor, and the present exemplary embodiment is not particularly limited thereto.

The switch elements (i.e., the first switch element T1 and the second switch element T2) and the driving transistor DT each are an N-type thin film transistor, the first power supply signal ELVDD is a high level signal, and the second power supply signal ELVSS is a low level signal; or the switch elements (i.e., the first switch element T1 and the second switch element T2) and the driving transistor DT each are a P-type thin film transistor, the first power supply signal ELVDD is a low level signal, and the second power supply signal ELVSS is a high level signal.

The photosensitive element 110 may include a PN junction type photosensitive diode, a PIN junction type photosensitive diode, an avalanche type photosensitive diode, a Schottky junction type photosensitive diode and so on, and the present exemplary embodiment is not particularly limited thereto. The photosensitive element 110 may be disposed on a light-emitting light path of the electroluminescent element 120.

The process of compensating the data signal DATA according to the optical signal may be: calculating a compensation signal according to the optical signal, and compensating the data signal DATA according to the compensation signal. The specific process of calculating the compensation signal according to the optical signal is: comparing the optical signal with a reference signal to calculate the compensation signal, wherein the reference signal may be an optical signal converted from normal display brightness. Of course, those skilled in the art may also use other methods to compensate the data signal DATA, and the present exemplary embodiment is not particularly limited thereto.

On the basis of this, the external compensation circuit 130 may include a modulation and demodulation sub-circuit 131, and the modulation and demodulation sub-circuit 131 may be configured to demodulate the optical signal according to the frequency of the scanning signal G. The modulation and demodulation sub-circuit 131 is connected to the detection line SENSE. The modulation and demodulation sub-circuit 131 can demodulate the optical signal according to the frequency of the scanning signal G, so that the demodulated optical signal is not interfered by the same column of pixels and the external light intensity, thereby making the compensation more accurate.

On the basis of this, the external compensation circuit 130 may further include an operational amplifier A and a resistor R, and the operational amplifier A may include a first terminal, a second terminal, and a third terminal, wherein the first terminal of the operational amplifier A is connected to the detection line SENSE, the second terminal of the operational amplifier A receives the second power supply signal ELVSS, and the third terminal of the operational amplifier A is connected to the modulation and demodulation sub-circuit 131. The resistor R is connected between the first terminal and the third terminal of the operational amplifier A. The first terminal of the operational amplifier A may be a non-inverting input terminal, the second terminal of the operational amplifier A may be an inverting input terminal, and the third terminal of the operational amplifier A may be an output terminal; or, the first terminal of the operational amplifier A may be an inverting input terminal, the second terminal of the operational amplifier A may be a positive input terminal, and the third terminal of the operational amplifier A may be an output terminal.

It can be seen from the above that the optical signal of the electroluminescent element 120 is obtained by the photosensitive element 110, that is, the luminous intensity of the electroluminescent element 120 is sensed by the photosensitive element 110, and the sensed luminous intensity is converted into an optical signal to compensate the data signal DATA according to the optical signal. Compared with the prior art, it can not only compensate the display abnormality caused by the characteristic change of the driving transistor DT, but can also compensate the display abnormality caused by the aging of the electroluminescent element 120 in the pixel, and the compensation range is large, thereby ensuring the uniformity of the display brightness of each pixel. In addition, compared with the prior art, on the basis of not increasing the transistors, compensation can be realized only by the photosensitive element, and the aperture ratio is increased, further reducing the influence of the aperture ratio.

In addition, when a plurality of the pixel circuits are arranged in an array, in order to share an external compensation circuit to simplify the circuit structure of the plurality of pixel circuits arranged in the array, the detection lines in the pixel circuits belonging to the same column and driving the electroluminescent elements to emit light at different times are connected to the same external compensation circuit; or the detection lines in the pixel circuits belonging to different columns and driving the electroluminescent elements to emit light at different times are connected to the same external compensation circuit.

Figure 2:
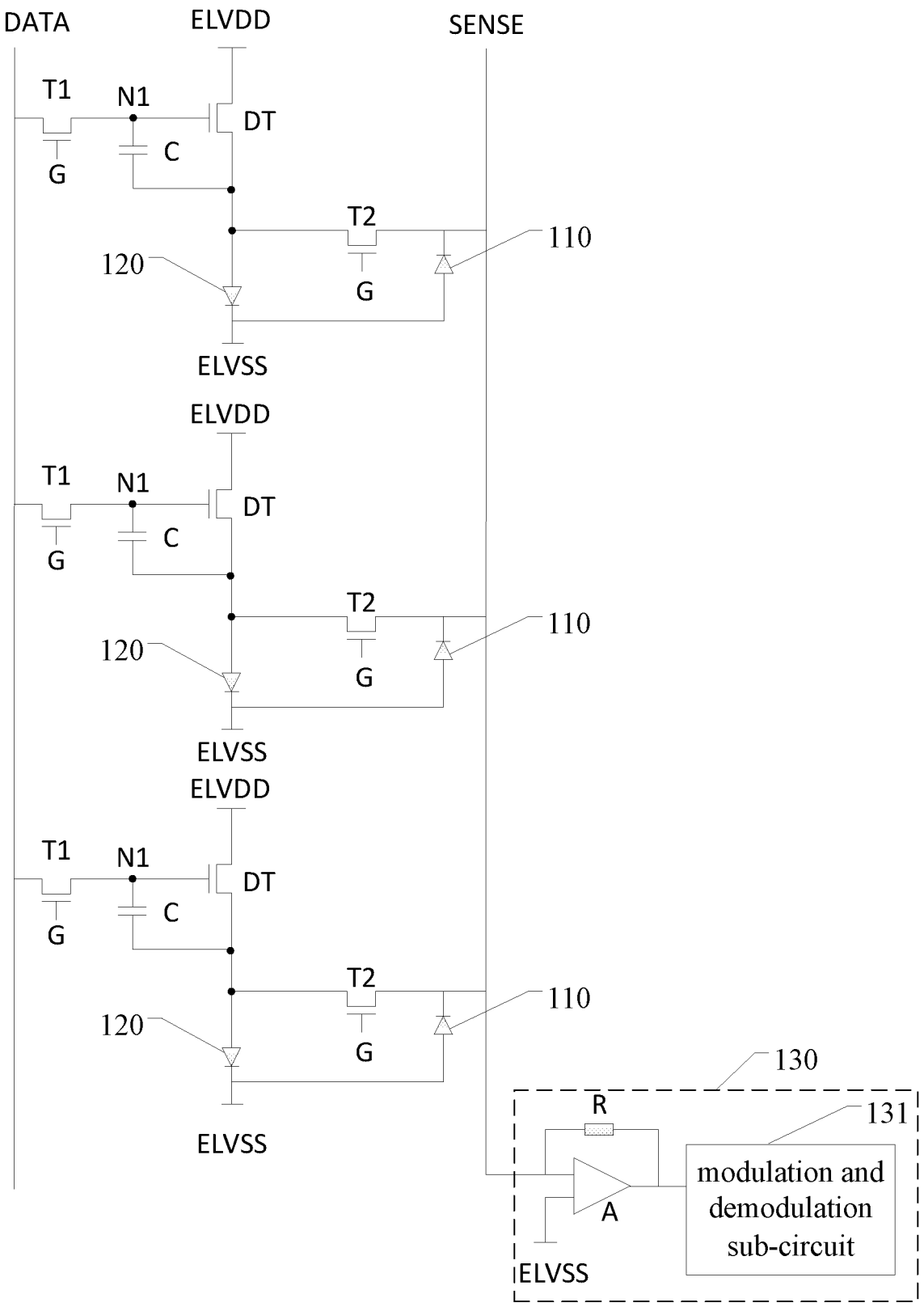
FIG. 2 is a schematic structural diagram of three pixel circuits arranged in three rows provided in an exemplary embodiment of the present disclosure.

In the present exemplary embodiment, the pixel circuits belonging to the same column and driving the electroluminescent elements to emit light at different times may share one external compensation circuit; or the pixel circuits belonging to different columns and driving the electroluminescent elements to emit light at different times may share one external compensation circuit. For example, if a plurality of pixel circuits are arranged in N rows and N columns and are scanned line-by-line, that is, the pixel circuits in the same row drive the electroluminescent elements to emit light at the same time, and the pixel circuits in different rows drive the electroluminescent elements to emit light at different times. On the basis of this, the detection lines in the pixel circuits in the same column can be connected to the same external compensation circuit; or the pixel circuits in the same column may be divided into a plurality of pixel circuit groups, and the detection lines in a plurality of pixel circuits in each pixel circuit group are connected to the same external compensation circuit; or the detection lines in the pixel circuits in different columns and driving the electroluminescent elements to emit light at different times are connected to the same external compensation circuit. It is shown in FIG. 2 that three pixel circuits are arranged in three rows and are scanned line-by-line, that is, the three pixel circuits drive the electroluminescent elements 120 to emit light at different times, and therefore, the detection lines in the three pixel circuits are connected to the same external compensation circuit 130.

In an exemplary embodiment of the present disclosure, there is also provided a pixel circuit driving method for driving the pixel circuit as shown in FIG. 1.

Figure 3:
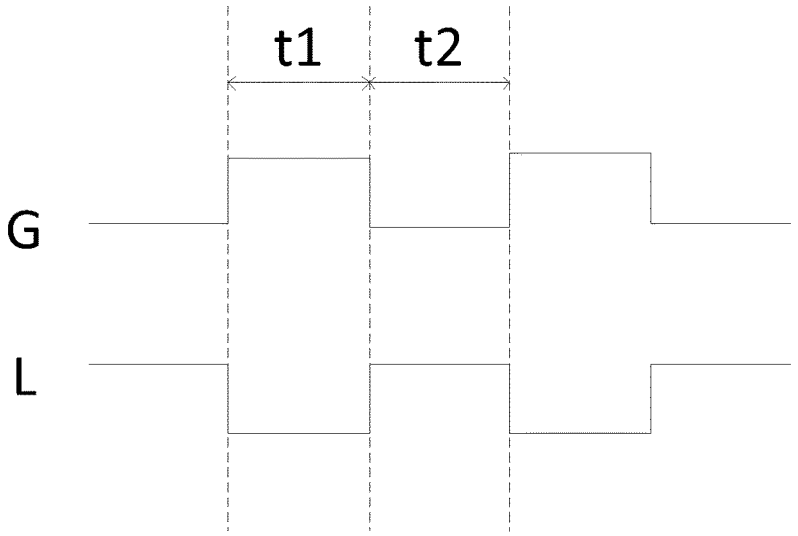
FIG. 3 is a timing diagram of a pixel circuit provided in an exemplary embodiment of the present disclosure.

Hereinafter, the operation process of the pixel circuit in FIG. 1 will be described in detail in conjunction with the operation timing chart of the pixel circuit shown in FIG. 3. Taking a case where the switch elements (i.e., the first switch element T1 and the second switch element T2) each are an N-type thin film transistor and the driving transistor DT is an N-type driving transistor as an example, since the switch elements (i.e., the first switch element T1 and the second switch element T2) each are an N-type thin film transistor, the conduction levels of the switch elements (i.e., the first switch element T1 and the second switch element T2) each are a high level, the first power supply signal ELVDD is a high level signal, and the second power supply signal ELVSS is a low level signal. The operation timing chart depicts the scan signal G and the optical signal L of the electroluminescent element 120.

Figure 4:
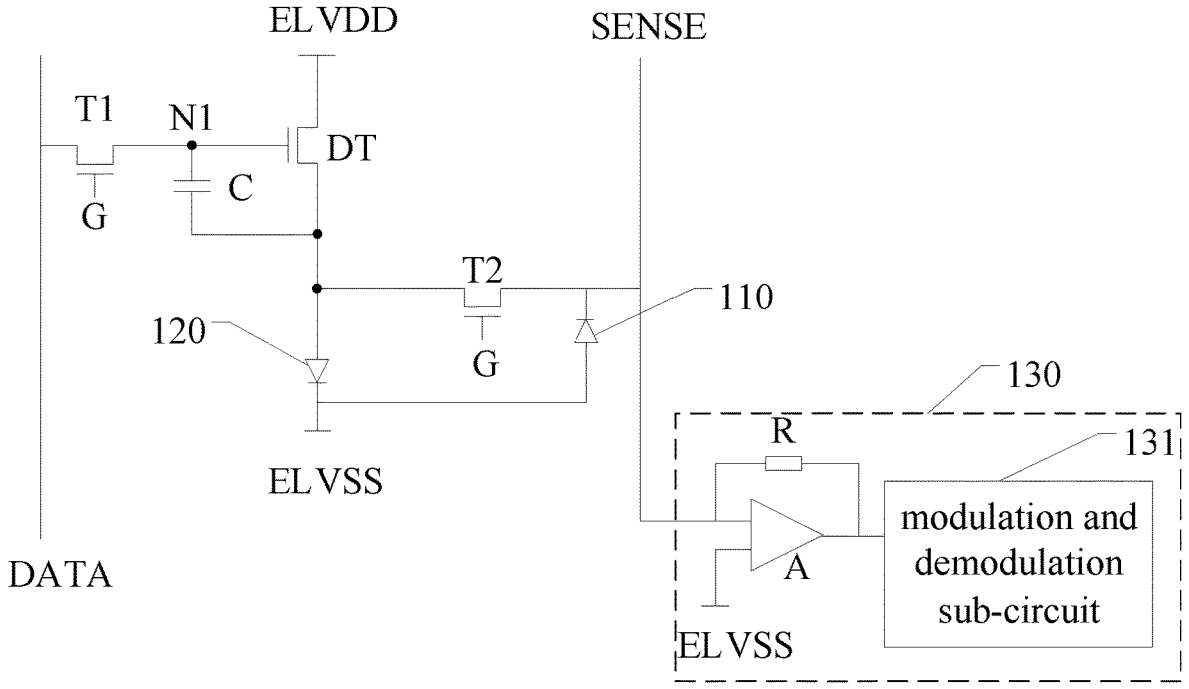
FIG. 4 is an equivalent circuit diagram of a charging phase provided in an exemplary embodiment of the present disclosure.

In the charging phase (i.e., the t1 phase), the first switch element T1 and the second switch element T2 are turned on with the scan signal G, the data signal DATA is transmitted to the first node N1, and the second power supply signal ELVSS is transmitted to a first electrode of the electroluminescent element 120 to charge the storage capacitor C by the data signal DATA and the second power supply signal ELVSS, while the second power supply signal ELVSS resets the first electrode of the electroluminescent element 120 to eliminate the influence of a previous frame signal. In the present exemplary embodiment, the scan signal G is at a high level. As shown in FIG. 4, the first switch element T1 and the second switch element T2 each are turned on, and at this time, the data signal DATA is transmitted to the first node N1 through the first switch element T1, and since the second switch element T2 is turned on, the second power supply signal ELVSS is transmitted to the first electrode of the electroluminescent element 120 through the photosensitive element 110 and the second switch element T2. As can be seen from the figure, since at this time the first and second electrodes of the electroluminescent element 120 each receive the second power supply signal ELVSS, the electroluminescent element 120 does not emit light as shown in FIG. 3; and since the storage capacitor C is connected between the first node N1 and the first electrode of the electroluminescent element 120, the data signal DATA and the second power supply signal ELVSS simultaneously charge the storage capacitor C.

Figure 5:
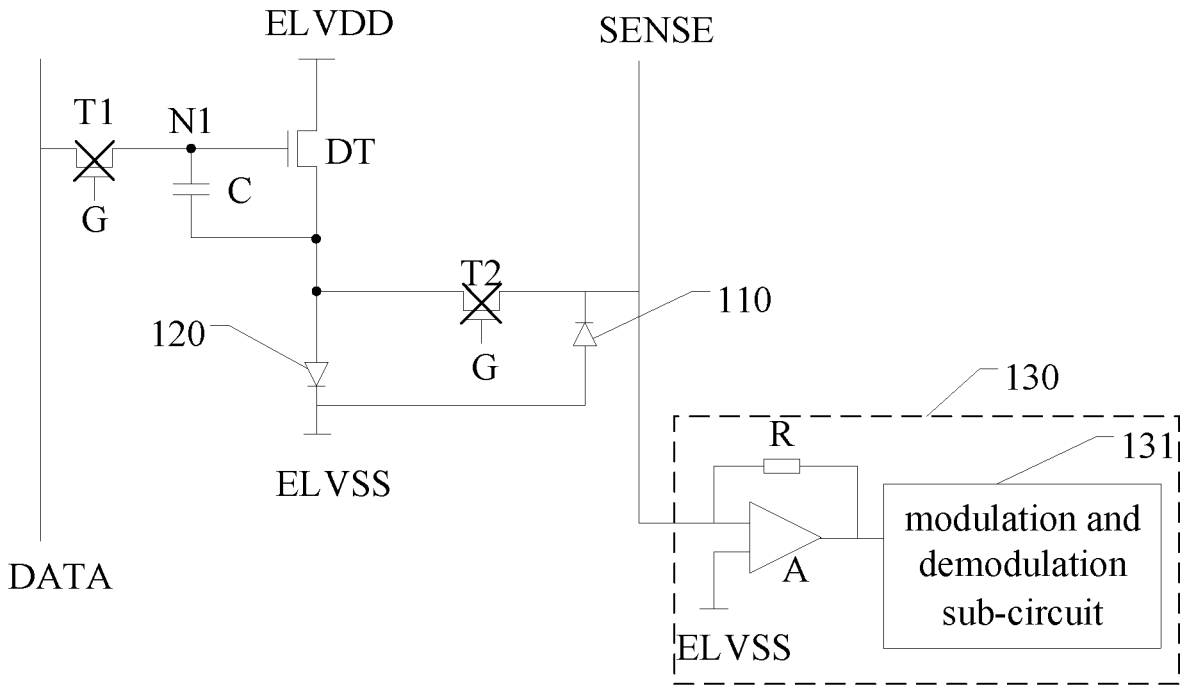
FIG. 5 is an equivalent circuit diagram of a light emitting phase provided in an exemplary embodiment of the present disclosure.

In the light emitting phase (i.e., the t2 phase), the driving transistor DT is turned on with the signal of the first node N1, and the driving current is outputted under the action of the first power supply signal ELVDD to drive the electroluminescent element 120 to emit light, and the photosensitive element 110 acquires and transmits the optical signal of the electroluminescent element 120 to the external compensation circuit 130 through the detection line SENSE, so that the external compensation circuit 130 compensates the data signal DATA in accordance with the optical signal. In the present exemplary embodiment, the scan signal G is a low level signal. As shown in FIG. 5, the first switch element T1 and the second switch element T2 each are turned off. At this time, the driving transistor DT is turned on under the action of the signal (i.e., the signal stored in the storage capacitor C) of the first node N1, and a driving current is outputted under the action of the first power supply signal ELVDD to drive the electroluminescent element 120 to emit light. At the same time, the photosensitive element 110 acquires the optical signal of the electroluminescent element 120. That is, the photosensitive element 110 senses the light intensity of the electroluminescent element 120, and converts the sensed light intensity into an optical signal, to transmit the optical signal to the external compensation circuit 130 through the detection line SENSE, so that the external compensation circuit 130 calculates a compensation signal according to the optical signal, and compensate the data signal DATA according to the compensation signal, thereby ensuring the uniformity of display brightness of each pixel. It should be noted that the external compensation circuit 130 may be configured in a driving IC, and the present exemplary embodiment is not particularly limited thereto. The photosensitive element 110 may include a PN junction type photosensitive diode, a PIN junction type photosensitive diode, an avalanche type photosensitive diode, a Schottky junction type photosensitive diode, and so on, and the present exemplary embodiment is not particularly limited thereto.

Further, the external compensation circuit 130 may include a modulation and demodulation sub-circuit 131. On the basis of this, the external compensation circuit 130 compensating the data signal DATA according to the optical signal may include: using the modulation and demodulation sub-circuit 131 to demodulate the optical signal according to the frequency of the scan signal G, and compensating the data signal DATA according to the demodulated optical signal.

In the present exemplary embodiment, since the scan signal G is switched between a low level signal and a high level signal according to a frequency, the electroluminescent element 120 also emits light according to the frequency of the scanning signal G, and the optical signal acquired by the photosensitive element 110 is a modulated optical signal whose frequency is the frequency of the scanning signal G. On the basis of this, the modulation and demodulation sub-circuit 131 demodulates the optical signal according to the frequency of the scanning signal G to calculate a compensation signal based on the demodulated optical signal, and compensates the data signal DATA according to the compensation signal. Since the modulation and demodulation sub-circuit 131 is employed, the obtained demodulated optical signal is not interfered by the same column of pixels and the external light intensity, so that the compensation is more accurate.

In summary, the optical signal of the electroluminescent element is obtained by the photosensitive element, that is, the luminous intensity of the electroluminescent element is sensed by the photosensitive element, and the sensed luminous intensity is converted into an optical signal to compensate the data signal according to the optical signal. Compared with the prior art, it can not only compensate the display abnormality caused by the characteristic change of the driving transistor, but can also compensate the display abnormality caused by the aging of the electroluminescent element in the pixel, and the compensation range is large, thereby ensuring the uniformity of the display brightness of each pixel. In addition, compared with the prior art, on the basis of not increasing the transistors, compensation can be realized only by the photosensitive element, and the aperture ratio is increased, further reducing the influence of the aperture ratio.

It should be noted that, in the above embodiments, all the switch elements each are an N-type thin film transistor. However, those skilled in the art can easily obtain a pixel circuit where all the switch elements each are a P-type thin film transistor according to the pixel circuit provided by the present disclosure. Since all of the switch elements are P-type thin film transistors, the conductive signals of all the switch elements each are a low level. The use of all P-type thin film transistors has the following advantages: for example, strong noise suppression; for example, since they are turned on with a low level, a low level in charge management being easy to implement; for example, a P-type thin film transistor being simple in process and relatively low in price; for example, P-type thin film transistors having better stability and the like.

Of course, the pixel circuit provided by the present disclosure may be changed to a Complementary Metal Oxide Semiconductor (CMOS) circuit or the like, and is not limited to the pixel circuit provided in the present embodiment, and details are not described herein again.

The present exemplary embodiment also provides a display device including the pixel circuit described above. The display device includes: a plurality of scan lines configured to provide scan signals; a plurality of data lines configured to provide data signals; and a plurality of pixel circuits electrically connected to the scan lines and the data lines, wherein at least one of the pixel circuits is any one of the pixel circuits described above in the present exemplary embodiment. The display device may include any product or component having a display function, such as a mobile phone, a tablet computer, a television, a notebook computer, a digital photo frame, or a navigator.

It should be noted that the specific details of each module unit in the display device have been described in detail in the corresponding pixel circuit, and thus are not be described herein again.

An exemplary embodiment of the present disclosure provides a pixel circuit, a driving method thereof, and a display device. The pixel circuit acquires an optical signal of the electroluminescent element through the photosensitive element at the stage of driving the electroluminescent element to emit light, so that the external compensation circuit collects the optical signal acquired by the photosensitive element through the detection line at the stage where the pixel circuit drives the electroluminescent element to emit light, and compensates the data signal according to the optical signal. On one hand, the optical signal of the electroluminescent element is obtained by the photosensitive element, that is, the luminous intensity of the electroluminescent element is sensed by the photosensitive element, and the sensed luminous intensity is converted into an optical signal to compensate the data signal according to the optical signal. Compared with the prior art, it can not only compensate the display abnormality caused by the characteristic change of the driving transistor, but can also compensate the display abnormality caused by the aging of the electroluminescent element in the pixel, and the compensation range is large, thereby ensuring the uniformity of the display brightness of each pixel. On the other hand, compared with the prior art, on the basis of not increasing the transistors, compensation can be realized only by the photosensitive element, and the aperture ratio is increased, further reducing the influence of the aperture ratio.

It should be noted that although several modules or units of the device for performing actions are mentioned in the detailed description above, such division is not mandatory. Actually, in accordance with embodiments of the present disclosure, the features and functions of two or more modules or units described above may be embodied in one module or unit. Conversely, the features and functions of one module or unit described above may be further divided and embodied by multiple modules or units.

Furthermore, although the respective steps of the method of the present disclosure are described in a specific order in the drawings, this is not required or implied that the steps must be performed in the specific order, or all the steps shown must be performed to achieve the desired result. Additionally or alternatively, certain steps may be omitted, multiple steps may be combined into one step for performing, and/or one step may be decomposed into multiple steps for performing.

After considering the specification and practicing the content disclosed herein, those skilled in the art would be easy to conceive of other embodiments of the present disclosure. The present application is intended to cover any variations, uses, or adaptations of the present disclosure, and these variations, uses, or adaptations follow the general principles of the present disclosure and include common general knowledge or customary technical means in the art that are not disclosed in the present disclosure. The specification and embodiments are to be regarded as illustrative only, and the true scopes and spirits of the present disclosure are pointed out by the appended claims.

What is claimed is:

1. A pixel circuit for driving an electroluminescent element to emit light, comprising:

a first switch element configured to be turned on in response to a scan signal, and transmit a data signal to a first node;

a driving transistor configured to be turned on in response to a signal of the first node, and output a driving current to a first electrode of the electroluminescent element under the action of a first power supply signal;

a storage capacitor having a first terminal being connected to the first node, and a second terminal being connected to the first electrode of the electroluminescent element, and a second electrode of the electroluminescent element receiving a second power supply signal;

a second switch element configured to be turned on in response to the scan signal, and communicate with the first electrode of the electroluminescent element and a detection line; and a photosensitive element connected to the detection line, and configured to acquire an optical signal of the electroluminescent element, so that an external compensation circuit collects an optical signal acquired by the photosensitive element through the detection line at a stage in which the pixel circuit drives the electroluminescent element to emit light, and compensates the data signal according to the optical signal, wherein a plurality of pixel circuits each being the pixel circuit are arranged in an array, and wherein:

detection lines in the pixel circuits belonging to a same column and driving the electroluminescent elements to emit light at different times are connected to a same external compensation circuit; or detection lines in the pixel circuits belonging to different columns and driving the electroluminescent elements to emit light at different times are connected to a same external compensation circuit.

2. The pixel circuit according to claim 1, wherein:

the first switch element has a control terminal receiving the scan signal, a first terminal receiving the data signal, and a second terminal connected to the first node;

the driving transistor has a control terminal connected to the first node, a first terminal receiving the first power supply signal, and a second terminal connected to the first electrode of the electroluminescent element;

the second switch element has a control terminal receiving the scan signal, a first terminal connected to the detection line, and a second terminal connected to the first electrode of the electroluminescent element; and the photosensitive element has a first electrode connected to the second electrode of the electroluminescent element and a second electrode connected to the detection line.

3. The pixel circuit according to claim 1, wherein the external compensation circuit comprises: a modulation and demodulation sub-circuit configured to demodulate the optical signal according to a frequency of the scan signal.

4. The pixel circuit according to claim 3, wherein the external compensation circuit further comprises:

an operational amplifier having a first terminal connected to the detection line, a second terminal connected to the second power supply signal, and a third terminal connected to the modulation and demodulation sub-circuit; and a resistor connected between the first terminal and the third terminal of the operational amplifier.

5. The pixel circuit according to claim 4, wherein:

the first terminal of the operational amplifier is a non-inverting input terminal, the second terminal of the operational amplifier is an inverting input terminal, and the third terminal of the operational amplifier is an output terminal; or the first terminal of the operational amplifier is an inverting input terminal, the second terminal of the operational amplifier is a positive input terminal, and the third terminal of the operational amplifier is an output terminal.

6. The pixel circuit according to claim 1, wherein the photosensitive element comprises a PIN junction type photosensitive diode, a PN junction type photosensitive diode, an avalanche type photosensitive diode or a Schottky junction type photosensitive diode.

7. The pixel circuit according to claim 1, wherein:

the first and second switch elements and the driving transistor each is an N-type thin film transistor, the first power supply signal is a high level signal, and the second power supply signal is a low level signal; or the first and second switch elements and the driving transistor each is a P-type thin film transistor, the first power supply signal is a low level signal, and the second power supply signal is a high level signal.

8. The pixel circuit according to claim 1, wherein the first switch element and the second switch element correspond to a first switch transistor and a second switch transistor, respectively, each switch transistor having a control terminal, a first terminal and the second terminal.

9. The pixel circuit according to claim 1, wherein the photosensitive element is disposed on a light-emitting light path of the electroluminescent element.

10. A pixel circuit driving method for driving a pixel circuit that drives an electroluminescent element to emit light, comprising:

providing the pixel circuit, the pixel circuit comprising:

a first switch element configured to be turned on in response to a scan signal, and transmit a data signal to a first node;

a driving transistor configured to be turned on in response to a signal of the first node, and output a driving current to a first electrode of the electroluminescent element under the action of a first power supply signal;

a storage capacitor having a first terminal being connected to the first node, and a second terminal being connected to the first electrode of the electroluminescent element, and a second electrode of the electroluminescent element receiving a second power supply signal;

a second switch element configured to be turned on in response to the scan signal, and communicate with the first electrode of the electroluminescent element and a detection line; and a photosensitive element connected to the detection line, and configured to acquire an optical signal of the electroluminescent element, so that an external compensation circuit collects an optical signal acquired by the photosensitive element through the detection line at a stage in which the pixel circuit drives the electroluminescent element to emit light, and compensates the data signal according to the optical signal;

in a charging phase, turning on the first switch element and the second switch element with the scan signal, transmitting the data signal to the first node, and transmitting the second power supply signal to the first electrode of the electroluminescent element to charge the storage capacitor through the data signal and the second power supply signal; and in a light emitting phase, turning on the driving transistor with the signal of the first node, outputting the driving current under the action of the first power supply signal to drive the electroluminescent element to emit light, and acquiring and transmitting, by the photosensitive element, the optical signal of the electroluminescent element to the external compensation circuit through the detection line, so that the external compensation circuit compensates the data signal in accordance with the optical signal.

11. The pixel circuit driving method according to claim 10, wherein the external compensation circuit comprises a modulation and demodulation sub-circuit; and the external compensation circuit compensating the data signal according to the optical signal comprises: demodulating the optical signal according to a frequency of the scan signal by using the modulation and demodulation sub-circuit, and compensating the data signal according to the demodulated optical signal.

12. The pixel circuit driving method according to claim 10, wherein the photosensitive element comprises a PIN junction type photosensitive diode, a PN junction type photosensitive diode, an avalanche type photosensitive diode or a Schottky junction type photosensitive diode.

13. The pixel circuit driving method according to claim 10, wherein:

the first and second switch elements each is an N-type thin film transistor, and conduction levels of the switch elements each is a high level; or the first and second switch elements each is a P-type thin film transistor, and the conduction levels of the switch elements each is a low level.

14. The pixel circuit driving method according to claim 10, wherein the external compensation circuit is configured in a driving integrated circuit (IC).

15. A display device comprising an electroluminescent element and a pixel circuit for driving the electroluminescent element to emit light, the driving circuit comprising:

a first switch element configured to be turned on in response to a scan signal, and transmit a data signal to a first node;

a driving transistor configured to be turned on in response to a signal of the first node, and output a driving current to a first electrode of the electroluminescent element under the action of a first power supply signal;

a storage capacitor having a first terminal being connected to the first node, and a second terminal being connected to the first electrode of the electroluminescent element, and a second electrode of the electroluminescent element receiving a second power supply signal;

a second switch element configured to be turned on in response to the scan signal, and communicate with the first electrode of the electroluminescent element and a detection line; and a photosensitive element connected to the detection line, and configured to acquire an optical signal of the electroluminescent element, so that an external compensation circuit collects an optical signal acquired by the photosensitive element through the detection line at a stage in which the pixel circuit drives the electroluminescent element to emit light, and compensates the data signal according to the optical signal, wherein the external compensation circuit comprises: a modulation and demodulation sub-circuit configured to demodulate the optical signal according to a frequency of the scan signal, and wherein the external compensation circuit further comprises:

an operational amplifier having a first terminal connected to the detection line, a second terminal connected to the second power supply signal, and a third terminal connected to the modulation and demodulation sub-circuit; and a resistor connected between the first terminal and the third terminal of the operational amplifier.

16. The display device according to claim 15, wherein:

the first switch element has a control terminal receiving the scan signal, a first terminal receiving the data signal, and a second terminal connected to the first node;

the driving transistor has a control terminal connected to the first node, a first terminal receiving the first power supply signal, and a second terminal connected to the first electrode of the electroluminescent element;

the second switch element has a control terminal receiving the scan signal, a first terminal connected to the detection line, and a second terminal connected to the first electrode of the electroluminescent element; and the photosensitive element has a first electrode connected to the second electrode of the electroluminescent element and a second electrode connected to the detection line.

17. The display device according to claim 15, wherein a plurality of pixel circuits each being the pixel circuit are arranged in an array, and wherein:

detection lines in the pixel circuits belonging to a same column and driving the electroluminescent elements to emit light at different times are connected to a same external compensation circuit; or detection lines in the pixel circuits belonging to different columns and driving the electroluminescent elements to emit light at different times are connected to a same external compensation circuit.

* * * * *